US005435219A

United States Patent [19]

Huff

[11] Patent Number: 5,435,219

[45] Date of Patent: Jul. 25, 1995

[54] VIBRATO ASSEMBLY FOR STRINGED INSTRUMENTS

[76] Inventor: Richard E. Huff, 1408 Solana Dr., Belmont, Calif. 94002

[21] Appl. No.: 287,119

[22] Filed: Aug. 8, 1994

[51] Int. Cl.[6] ..... G10D 3/00

[52] U.S. Cl. ..... 84/313

[58] Field of Search ..... 84/297, 298, 313

[56] References Cited

U.S. PATENT DOCUMENTS

| | | | |
|---|---|---|---|
| 4,171,661 | 10/1979 | Rose | 84/313 |
| 4,457,201 | 7/1984 | Storey | 84/313 |
| 4,512,232 | 4/1985 | Schaller | 84/297 |
| 4,572,049 | 2/1986 | Tanaka et al. | 84/313 |
| 4,632,005 | 12/1986 | Steinberger | 84/313 |
| 4,768,415 | 9/1988 | Gressett, Jr. et al. | 84/298 |
| 4,867,031 | 9/1989 | Fender | 84/313 |
| 4,928,564 | 5/1990 | Borishoff et al. | 84/313 |
| 5,196,641 | 3/1993 | Schaller | 84/740 |
| 5,198,601 | 3/1993 | McCabe | 84/298 |

*Primary Examiner*—Howard B. Blankenship
*Assistant Examiner*—Patrick J. Stanzione
*Attorney, Agent, or Firm*—Saundra S. Hand

[57] ABSTRACT

A vibrato assembly for stringed instruments makes slight and rapid changes in the pitch of the tone produced by stringed instrument. Previously known vibrato assemblies use knife-edge hinges or rolling ball bearings to produce these variations. The vibrato assemblies described herein use flexure bearings to produce variations in the tension of the strings and thereby the pitch of the tones. These flexure bearing vibrato assemblies have the advantages of high strength, zero operational noise and rumble, and virtually zero friction and hysteresis. Additionally, flexure bearing vibrato assemblies provide a robust path between the instrument and the strings resulting in improved tonal quality, range, and sustain.

28 Claims, 14 Drawing Sheets

VIBRATO ASSEMBLY FOR STRINGED INSTRUMENTS

FIELD OF THE INVENTION

The invention relates to stringed musical instruments and more particularly to apparatuses for varying the tone produced by the strings.

BACKGROUND AND SUMMARY OF THE INVENTION

Vibrato is a slightly tremulous effect imparted to an instrumental tone for added warmth and expressiveness, consisting of slight and rapid variations in the pitch of the tone being produced. Stringed instruments, such as guitars, violins, violas, cellos, double basses, banjos, mandolins, etc., together with a few other instruments such as trombones, are unique in allowing the musician to produce any of a continuum of musical pitches by making slight variations in the position of fingers or in the configuration of the instrument. Among stringed instruments, this has led to the development and use of techniques to produce vibrato sounds by varying the position of the fingers along the strings.

Another way to produce vibrato sounds is by using a vibrato assembly that varies the tension of the strings while the fingers remain stationary. A conventional vibrato assembly (often called a tremolo tailpiece even though in stringed instruments tremolo usually refers to variations in the amplitude rather than in the pitch of the tone produced) has a bridge that rotates relative to the body of the stringed instrument about a knife-edge hinge or rolling ball bearings to produce variations in the tension of the strings and thereby variations in the pitch of the tone.

Previously known vibrato assemblies have several disadvantages. Knife-edge hinges and rolling ball bearings have friction that can produce wear on the pivoting surfaces and cause hysteresis (i.e., prevent the strings from returning precisely to their basic pitch). The pivoting of knife-edge hinges and rolling ball bearings produces undesirable noise and rumbling sounds that nearby electroacoustic pickups on electric stringed instruments detect and transmit to the amplifier. Knife-edge hinges and rolling ball bearings allow acoustic micro slip (i.e., sliding friction in the transmission of elastic strain waves) that prevents the efficient transfer of acoustic energy between the strings and the instrument body. This results in a loss of tonal quality (i.e., the number and relative intensity of the harmonics), frequency range, and sustain (i.e., an absence of energy loss that allows the string to vibrate freely). Also, because of the high line-contact or point-contact stresses present, even slight overloads can damage knife edges or ball-bearing races and thus cause increased friction, noise, and acoustic losses.

For the reasons previously discussed, it would be advantageous to have a vibrato assembly for stringed instruments that exhibits no wear or hysteresis, does not create extraneous noise, efficiently transfers acoustic energy from the strings to the instrument body, and withstands rugged use.

The present invention is a vibrato assembly in which all relative motion between its parts is achieved by means of elastic flexural members. It is applicable to instruments having one or more strings. It has a vibrato base attached to the instrument (e.g., the body or the neck of the instrument), a vibrato armature means for supporting a string, and an elastic flexure pivot for allowing relative movement between the vibrato base and vibrato armature that varies the tension of the string. (The present use of the term "armature" is consistent with its use as the name of the moving part in wire strain gages, electromechanical relays, etc.) An instrument can have a single vibrato that varies the tension of all the strings or the instrument may have multiple vibratos, as many as one per string, each varying the tension of a subset of the strings.

The present invention has numerous advantages. The absence of any sliding or rolling contact eliminates the problems of friction and wear. The lack of surface friction coupled with the inherent restoring moment of the flexure pivots results in very low hysteresis. If suitable materials are employed, the hysteresis will be essentially zero-the strings will return exactly to their basic pitch. The operational noise of high-quality flexure pivots is negligible in comparison with that of knife-edge hinges and rolling ball bearings and is undetectable by conventional electro-acoustic pickups. This vibrato assembly provides a robust path for transmission of acoustic waves from the vibrating strings to the instrument body with minimal attenuation (energy loss) and distortion, resulting in improved tonal quality, range, and sustain. Also, it can be made sufficiently rugged to withstand accidents and abuse without performance degradation. An additional advantage of the present invention is that tonal characteristics can be altered by employing different materials.

DETAILED DESCRIPTION OF THE INVENTION

A person skilled in the art will readily appreciate the advantages and features of the disclosed invention after reading the following detailed description in conjunction with the drawings.

Figure 1A:
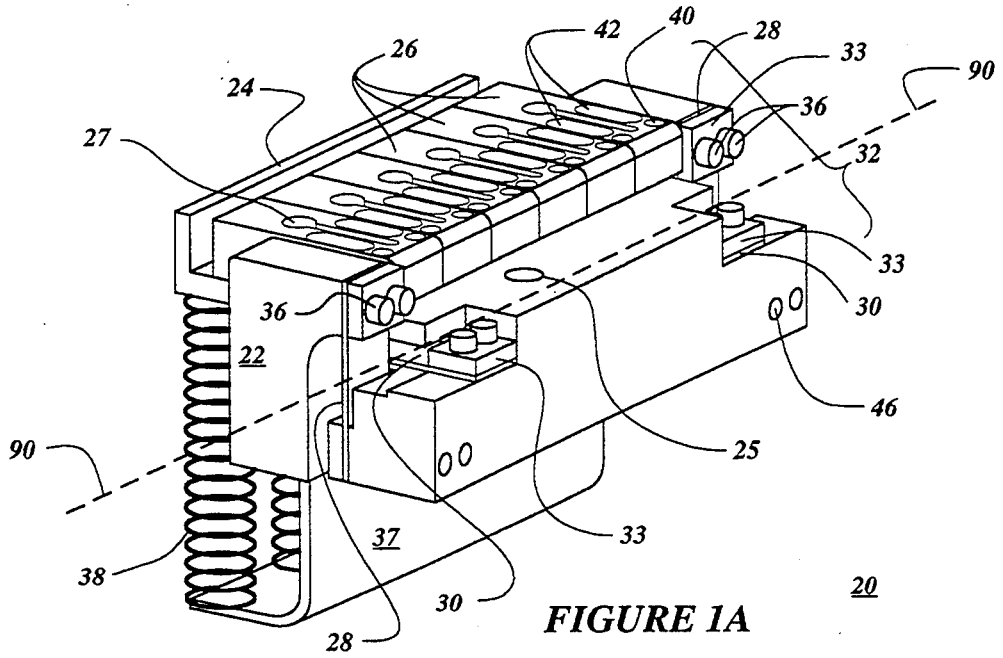
FIG. 1A is an isometric drawing of the preferred embodiment of the invention.
Figure 3:
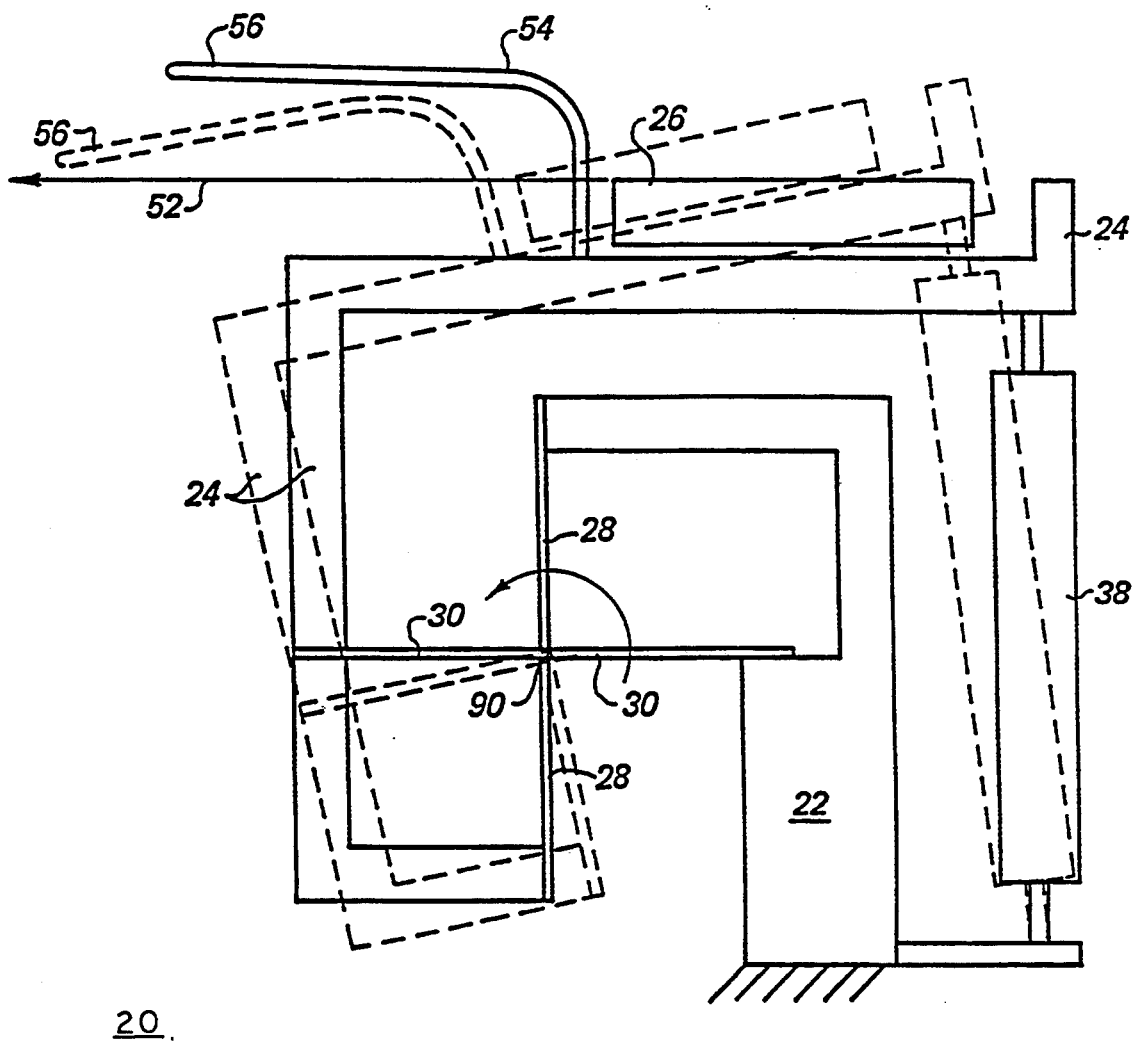
FIG. 3 is schematic drawing of the preferred embodiment of the invention showing the "rest" position and a "flexed" position, with an axis of rotation at the intersection of the flexure pivots.

FIG. 1A is an isometric drawing of the preferred embodiment of the invention. Vibrato assembly 20 has two cross-strip flexure pivot subassemblies 32 that connect a vibrato armature 24 to a vibrato base 22. Each flexure pivot subassembly 32 has a flexure plate 28 and a second flexure plate 30, each connecting vibrato base 22 to vibrato armature 24. Vibrato base 22 mounts on the stringed instrument and remains stationary when an actuating force operates on vibrato armature 24. Vibrato armature 24 responds to the actuating force by moving and varying the tensions of the strings. FIG. 3 shows that in the preferred embodiment the actuating force acts on vibrato armature 24, but the scope of the invention includes the application of actuating forces to any part of vibrato assembly 20.

When the actuating force acts on handle 54, flexure plate 28 and second flexure plate 30 deform to allow vibrato armature 24 to move and change the effective length and tension in strings 52. In the preferred embodiment, handle 54 is a removable lever arm that attaches to mount 25 shown in FIG. 1A and force is manually applied at handle 54 to impart the relative motion between vibrato armature 24 and vibrato base 22. The scope of the invention includes all types of handles and the use of a mechanical actuator to impart the relative motion.

Figure 1B:
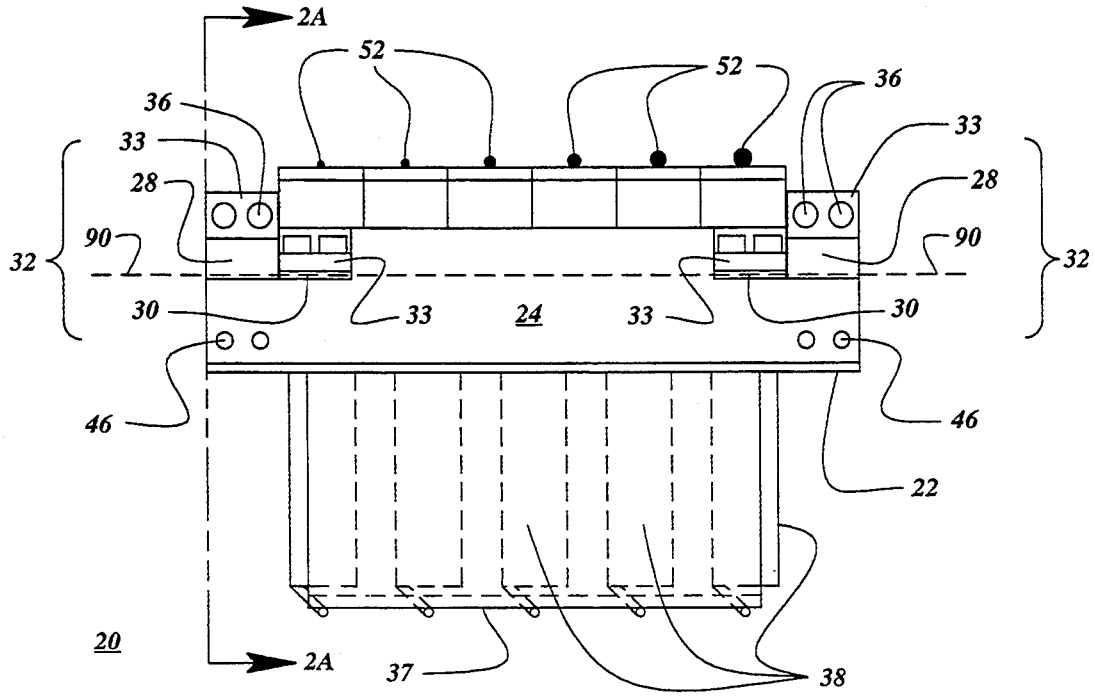
FIG. 1B is a front view of the preferred embodiment of the invention.

FIG. 1B is a front view of vibrato assembly 20. The bottom of vibrato armature 24 is slightly elevated above the bottom of vibrato base 22. A cross-strip flexure pivot subassembly 32 attaches to either side of vibrato assembly 20. String saddles 26 for each string 52 fasten to vibrato armature 24 and move with it. In the preferred embodiment of the invention, saddles 26 and vibrato armature 24 support and anchor strings 52. The ball end of each string 52 drops through string hole 27, shown in FIG. 1A, and slides underneath a string slot 29. The scope of the invention includes embodiments in which each string 52 anchors to something else. For example, each string 52 could anchor directly to the instrument and vibrato armature 24 would merely deflect (and stretch) strings 52.

By moving vibrato armature 24, the strings 52 stretch slightly and their tension varies to create corresponding variations in the pitch of their tones. Tension springs 38 connect between vibrato armature 24 and instrument 62, as shown in FIGS. 2C, 5A, 5B, and 7, and oppose the tension in strings 52.

Figure 2A:
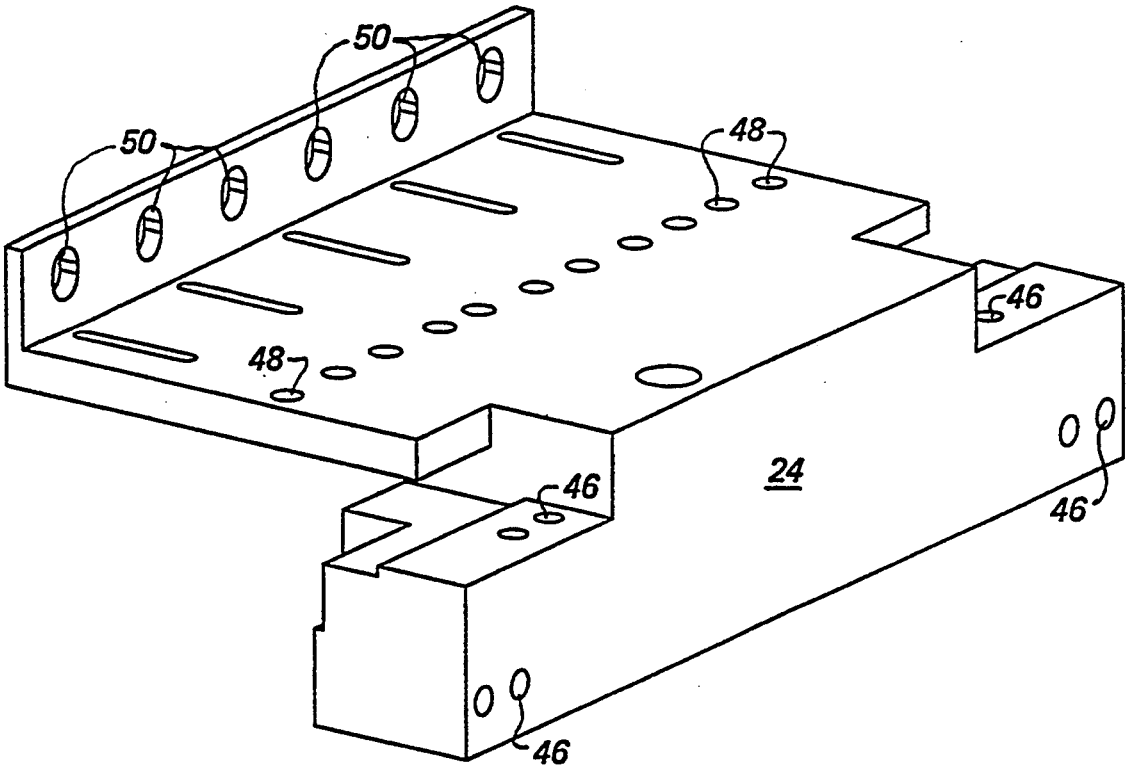
FIG. 2A shows the preferred embodiment of the vibrato armature.
Figure 2B:
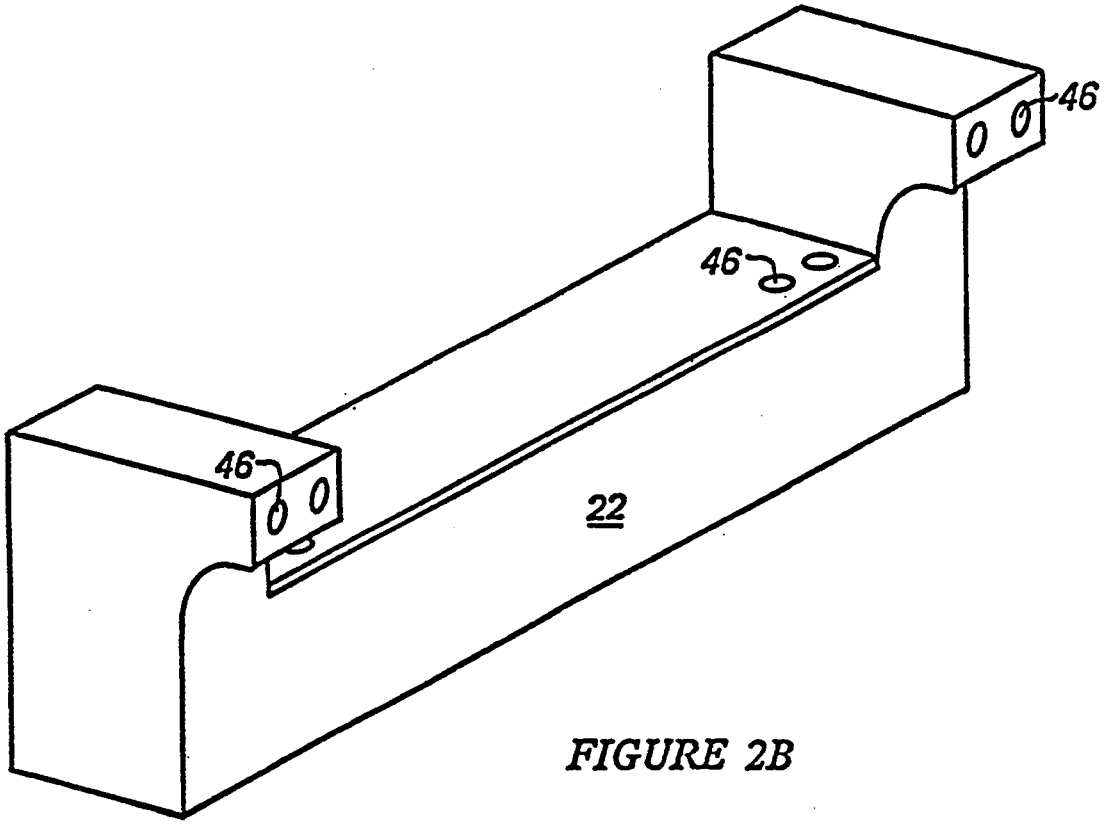
FIG. 2B shows the preferred embodiment of the vibrato base.
Figure 2C:
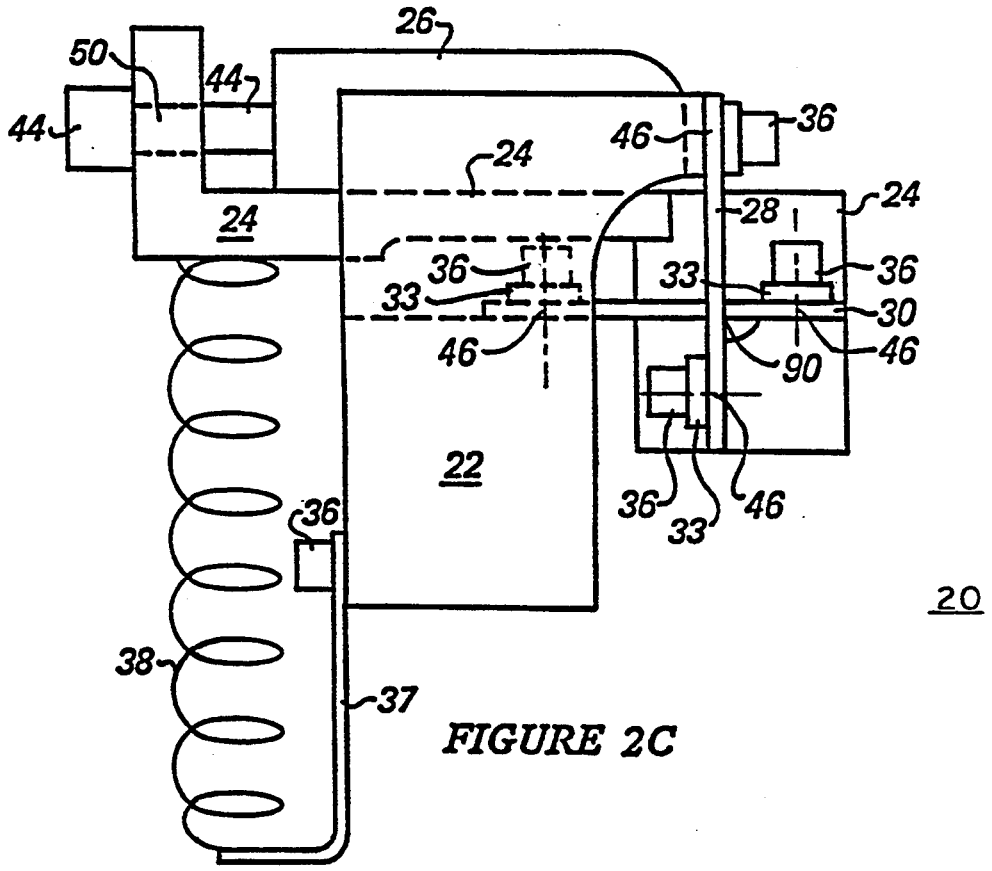
FIG. 2C is a side view of the vibrato assembly that illustrates the cross-strip flexure pivot.

Flexure pivot subassemblies 32, shown in FIGS. 1A, 1B, and 2C perform like a combination spring and bearing, but without friction. Previously known vibrato assemblies with their knife edge hinges or rolling ball bearings vary the tension in the strings by the frictional motion of one surface rolling or sliding over another. When a vibrato assembly 20 with flexure pivot subassemblies 32 moves to vary tension in the strings, one surface does not move against another. Instead, atomic bonds within flexures 28 and 30 stretch and the resulting motion is frictionless and quiet. Additionally, flexure pivot subassemblies 32 in the present invention act like center seeking springs and have virtually zero hysteresis. After termination of the actuating force on handle 54, shown in FIG. 3, the restoring forces of the stretched atomic bonds and springs 38 return vibrato armature 24 to its exact original position resulting in strings 52 producing tones at their original pitch.

It is important that the flexure plates (or strips) exhibit purely elastic behavior over the operational range of deflection. Any plastic (or viscoelastic, etc.) deformation will cause hysteresis and eventual failure of the flexure. The flexures should be made of a material capable of large purely elastic strains and fatigue resistance-typically a high strength metal (e.g., hardened tempered spring steel). If the flexures are of the clamped-spring type, it is important that the flexure plate clamp very securely because any slippage will cause hysteresis, operational noise, and acoustic losses. For ruggedness, the geometry of the vibrato base and vibrato armature should prevent bending of the flexures beyond their elastic limits. Ideally, the normal operating stresses in the flexures should not exceed approximately 25% of the yield strength, but can be as high as 30% depending on the material.

Figure 10:
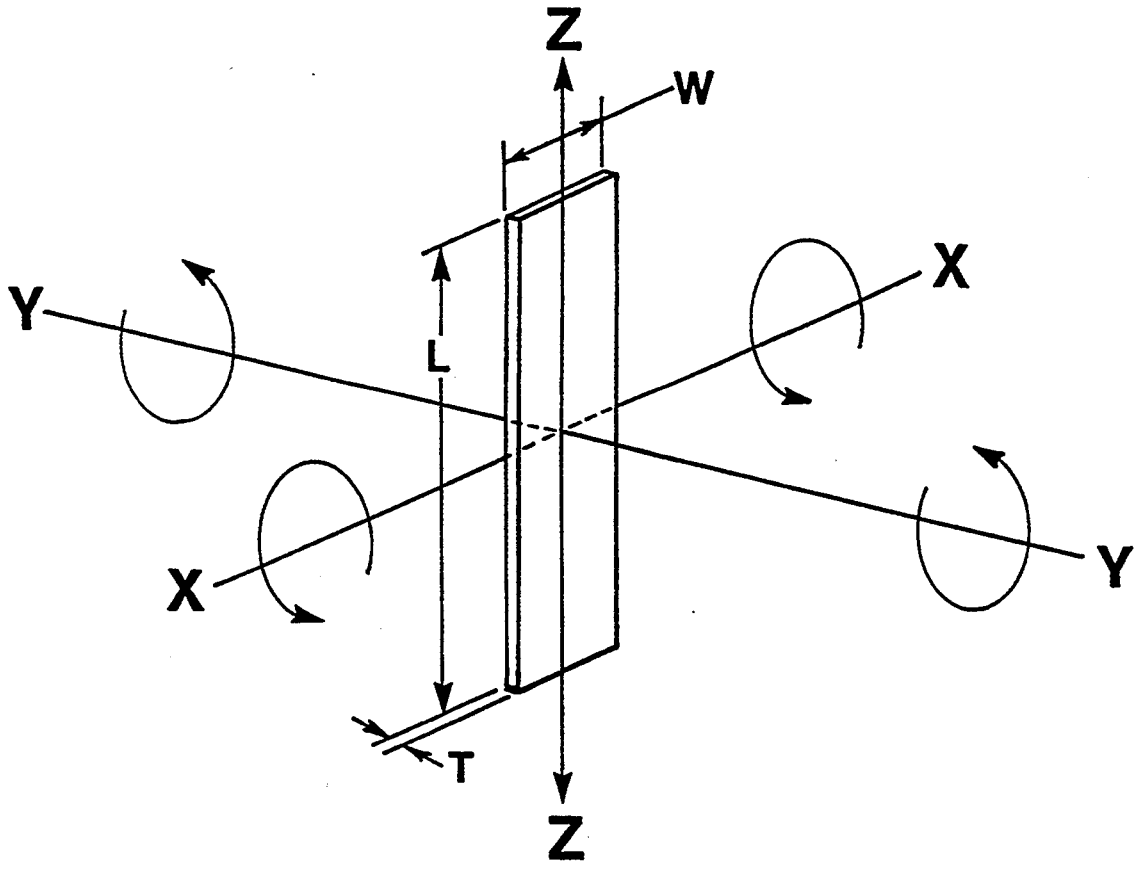
FIG. 10 shows a single flexure plate and its associated coordinate system.

For large elastic bending deflections, the thickness of a flexure plate, shown as T in FIG. 10, should be much smaller than its length, L. The thickness to effective length ratio is dependent on the specific application where resistance to fatigue and/or loading is a concern. FIG. 10 shows that the plate should have low resistance to bending around the x axis, but high resistance to bending around the y axis, and high resistance to lengthening, under tension, in the z axis, as shown in FIG. 10. A "cross-strip" flexure pivot subassembly employing two such plates will rotate easily about an axis parallel to (and near) the line of intersection of the planes of the two plates but will strongly resist all motion in other directions. If a vibrato assembly uses multiple flexure pivot subsassemblies and/or the flexure pivot subassembly employs more than two plates, it is important that the planes of all of the plates intersect on substantially a single axis.

For a general discussion of the design and application of flexure pivots, please consult the following references: "The Design of Flexure Pivots", Journal of The Aeronautical Sciences, Volume 5, November 1937, pp.16–21; F. S. Eastman, "Flexure Pivots to Replace Knife Edges and Ball Bearings", University of Washington Engineering Experiment Station Bulletin No.86, November 1935; F. S. Eastman, and R. V. Jones, "Some Uses of Elasticity in Instrument Design", Journal of Scientific Instruments, Volume 39, May 1962, pp. 193–203.

In the preferred embodiment, the flexure plates 28 and 30, shown in FIG. 1 A, are made of hardened beryllium copper, are approximately 0.4 mm thick and 9.5 mm wide, and have an active bending length (excluding clamped ends) of approximately 13 mm. The axis of rotation 90 is formed by the intersection of the plane of flexure plates 28 with plane of flexure plates 30 and is oriented to allow the vibrato armature 24 to move in a direction to vary the tension in the strings, but not in any other direction. In normal operation, flexure pivot subassemblies 32 rotate through an angle of approximately ±8 degrees, providing a range of string length adjustments of approximately 5 mm. A mechanical stop will limit the angle of rotation in both directions from going beyond a specified angle that is within the 25% of yield strength rule.

Another advantage of the rigidity of flexure pivot subassemblies 32 is that they readily transfer vibrational energy from strings 52 to instrument 62 and back to strings 52 again. Vibrational energy travels from strings 52 through: saddles 26, vibrato armature 24, flexure plates 28 and 30, vibrato base 22, into instrument 62, and back into strings 52 via the same path. The free and unimpeded transfer of acoustic energy between strings 52 and instrument 62 results in improved tonal quality, range, and sustain.

FIG. 2A shows vibrato armature 24 and FIG. 2B shows vibrato base 22. Vibrato armature 24 fits over and inside vibrato base 22. FIG. 2C is a side view of vibrato assembly 20 that illustrates the connections that cross-strip flexure pivot subassembly 32 makes with vibrato base 22 and vibrato armature 24. Fasteners 36 screw into fastener holes 46 and clamp flexures 28 and 30 to vibrato armature 24 and vibrato base 22. Although the preferred embodiment of the invention has flexure 28 positioned perpendicular to saddles 26 and has flexure 30 positioned parallel to saddles 26, the scope of the invention includes any orientation of flexures 28 and 30 relative to saddles 26.

Vibrato armature 24, shown in FIG. 2A, has holes for attaching saddles 26 to it. Intonation screw holes 50 accept intonation screws 44, one of which is shown in FIG. 2C, for precisely adjusting the length of string 52, opposing the string tension, and holding the string in place. Anchoring screws go through slotted holes 42, shown in FIG. 1A; screw into anchoring holes 48, shown in FIG. 2A; mount saddles 26 to vibrato armature 24; and transfer vibrational energy to armature 24. Set screws go in set screw holes 40 and terminate on vibrato armature 24. They position the height of saddle 26 and string 52 relative to vibrato armature 24.

FIG. 3 is a schematic drawing that shows the kinematics of vibrato assembly 20. When actuating force acts on handle 54, vibrato armature 24 moves, flexure plates 28 and 30 undergo elastic deformation, the tension in string 52 changes, and the pitch of the tone produce by string 52 changes. Upon termination of the actuating force, vibrato assembly 20 returns to its resting position indicated by the solid lines.

There are several types of flexure pivots. These include a single flexure and a cross-strip configuration employing two or more flexures. The latter provides the advantages of a well defined axis of rotation and rigidity at the expense of greater complexity. The flexures themselves are also of various forms. These include the clamped-flat-spring type, such as flexure plates 28 and 30, and the monolithic type, shown in FIG. 9. The latter precludes any possibility of friction, but is generally much more expensive to fabricate. The range of fabrication methods for the clamped-flat-spring type includes, but is not limited to soldering, welding, and/or bonding the flexure plates to the vibrato base and the vibrato armature. The preferred embodiment employs two cross-strip flexure pivot subassemblies, each having two clamped-flat-spring flexures. However, the scope of the invention includes vibrato assemblies employing any number of flexure pivot subassemblies of any configuration with flexures of any type. Also, vibrato assemblies incorporating combinations of flexure pivots and conventional bearings are within the scope of the invention. A few of the many possibilities are discussed below as alternate embodiments.

Figure 4A:
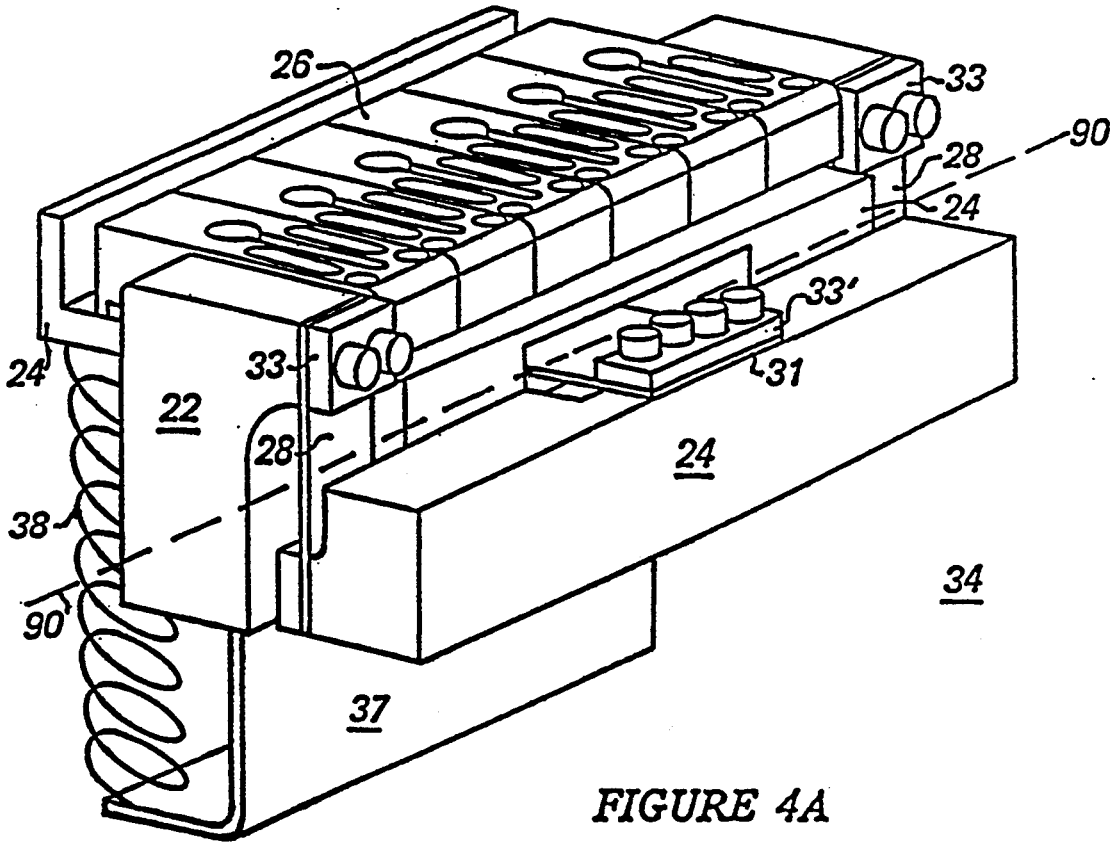
FIG. 4A is an isometric drawing of an alternate embodiment of the invention using cross-strip flexure pivots with the horizontal flexure plates moved to the center of the vibrato base and the vibrato armature.
Figure 4B:
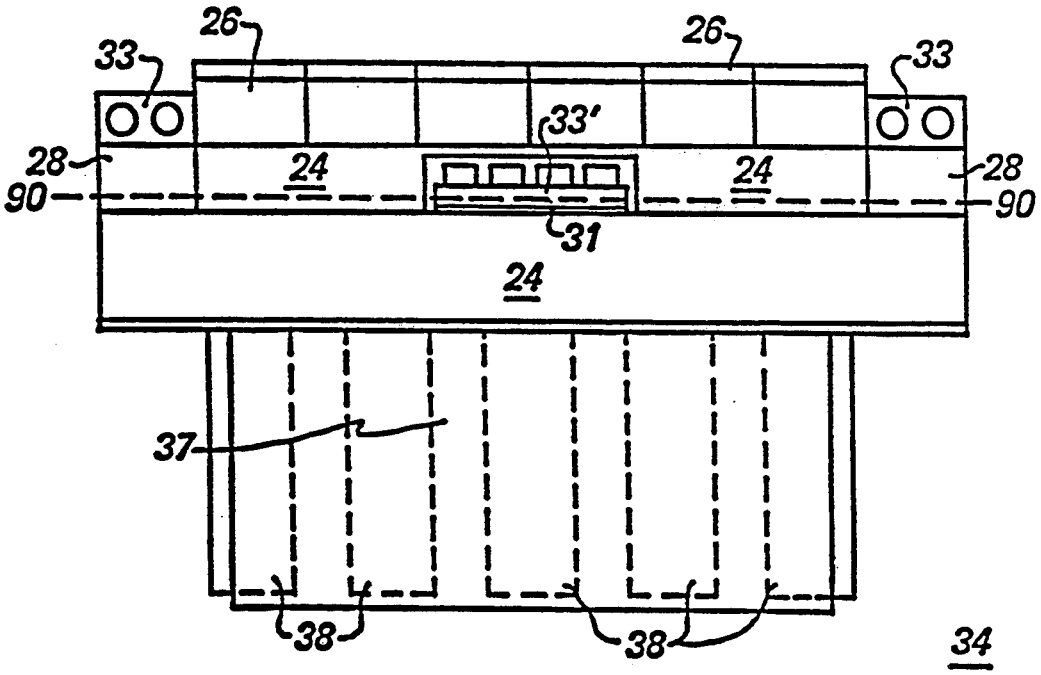
FIG. 4B is a front view of the alternate embodiment shown in FIG. 4A.

FIGS. 4A land 4B show a three flexure plate vibrato assembly 34. This variation of cross-strip flexure pivot subassemblies 32, shown in FIG. 1A, 1B and 2C has the horizontally oriented flexures 30 of FIG. 1A and 1B moved to the center of vibrato armature 24 and vibrato base 22 where they are merged together to form flexure 31. This configuration of a cross-strip flexure pivot subassembly is illustrated again in FIGS. 12A and 12B where it is used in an individually actuated vibrato subassembly 114 that varies the tension of just one string or a subset of all the strings.

Figure 5A:
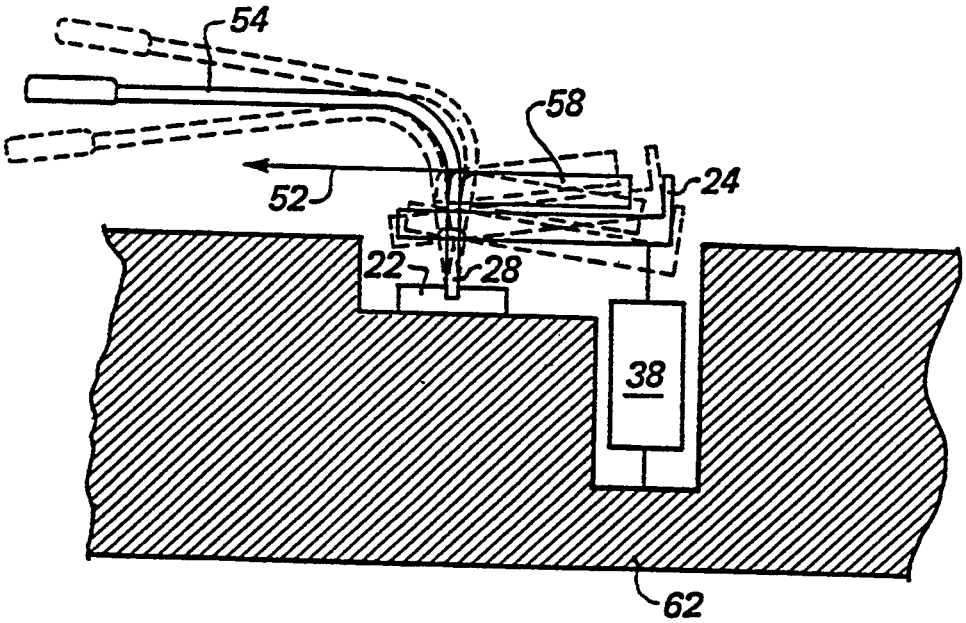
FIG. 5A shows an alternate embodiment of the invention having a single flexure.

FIG. 5A is a schematic drawing of a single flexure vibrato assembly 58. Vibrato base 22 is mounted in a recess of instrument 62, a single flexure 28 connects vibrato base 22 to vibrato armature 24. When force is applied to handle 54, vibrato assembly 58 moves and the tension in string 52 varies producing variations in the pitch of its tone. Tension spring 38, connected between instrument 62 and vibrato armature 24 opposes the tension in strings 52. In this embodiment, flexure 28 is placed in compression and must have sufficient stiffness to resist buckling under the applied load.

Figure 5B:
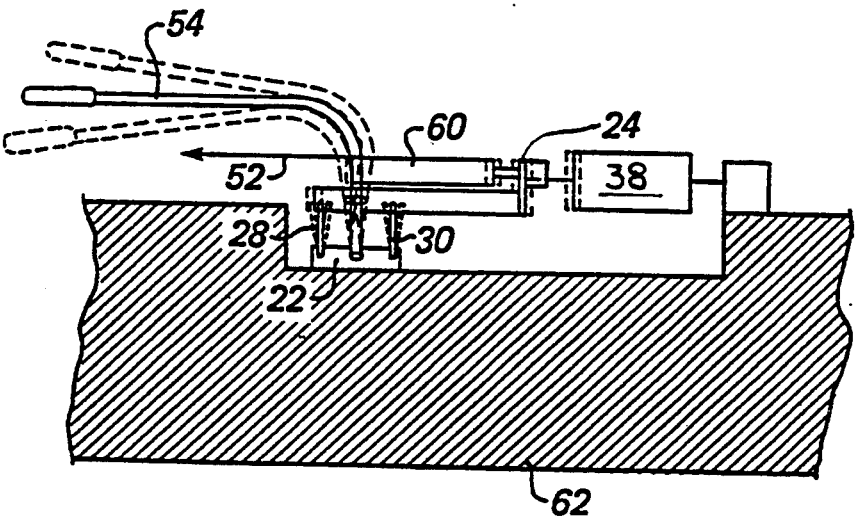
FIG. 5B shows an alternate embodiment of the invention having two flexures.

FIG. 5B is a schematic drawing of a double flexure vibrato assembly 60. It is identical to single flexure vibrato assembly 58 except that it has two flexures connecting vibrato armature 24 to vibrato base 22. This configuration causes vibrato armature 24 to move with a translating motion instead of a rotating motion. To oppose this translating motion, tension spring 38 mounts parallel to strings 52. In this embodiment, flexures 28 and 30 are placed in compression and must have sufficient stiffness to resist buckling under the applied load.

Figure 6A:
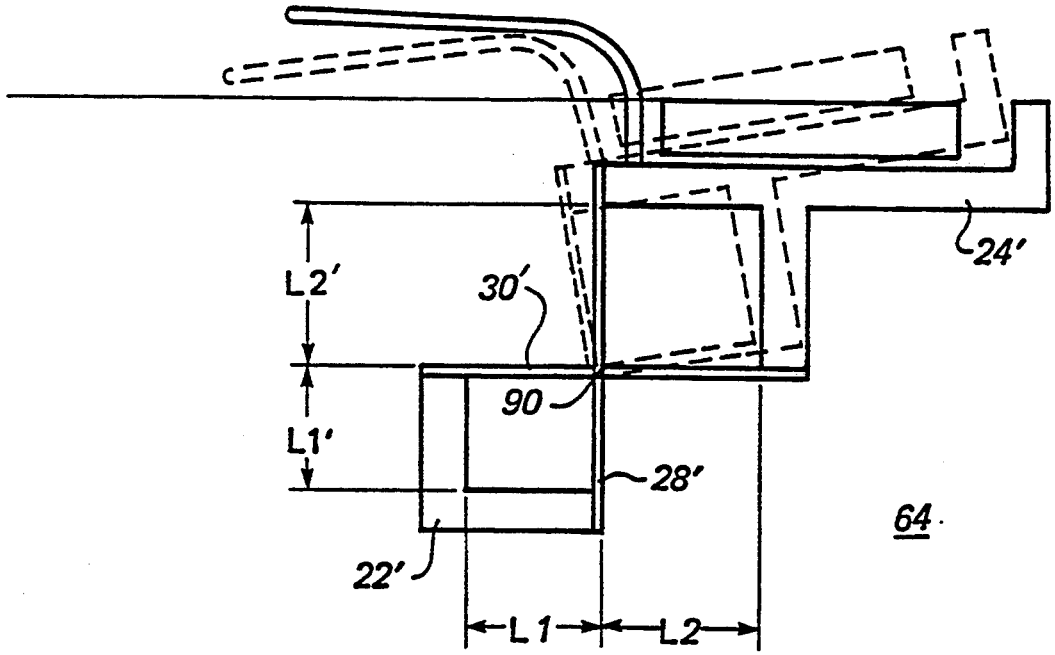
FIG. 6A shows an alternate embodiment of the invention having an asymmetrical flexure arrangement.

FIG. 6A is, a schematic drawing of an asymmetrical flexure pivot vibrato assembly 64. In this alternate embodiment, the asymmetrical flexure pivot subassembly is created by asymmetrical flexures 28' and 30' having sections of different lengths L1, L2, L1', and L2'. Asymmetrical vibrato base 22' and asymmetrical vibrato armature 24' are identical to vibrato armature 24 and vibrato base 22 except that they have a slightly different shape to accommodate flexures 28' and 30'. By varying the point of intersection of the flexures 28' and 30', the rotational stiffness increases and the displacement of the axis of rotation decreases. In this embodiment, flexures 28' and 30' are placed in compression and must have sufficient stiffness to resist buckling under the applied load.

Figure 6B:
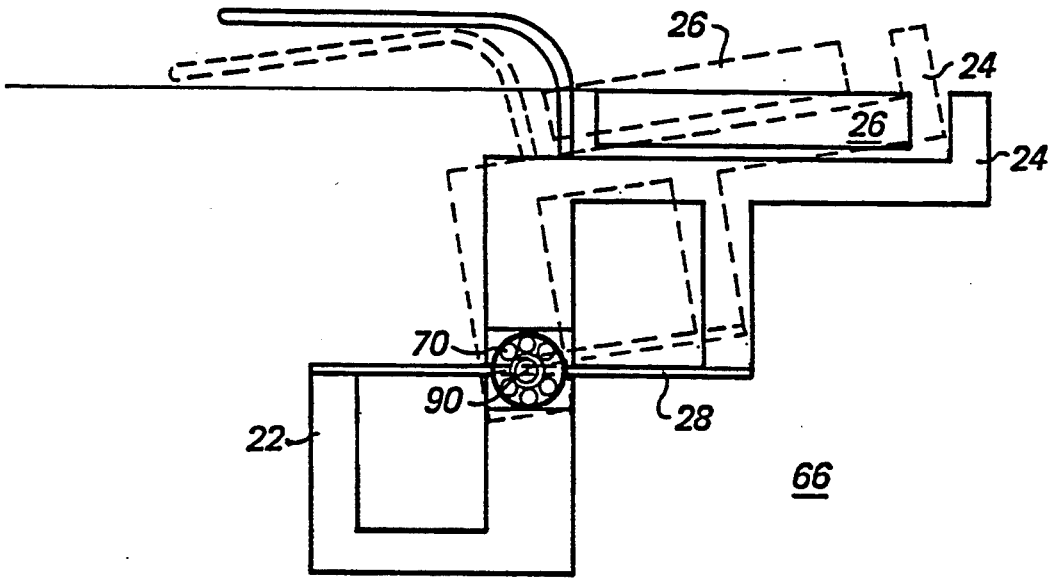
FIG. 6B shows an alternate embodiment of the invention having a combination flexure pivot and radial bearing where the vertical flexure is substituted with a shaft and bearing arrangement.

FIG. 6B is a schematic drawing of a vibrato assembly 66 combining a flexural pivot and a radial bearing. Radial bearing 70 connects a vibrato armature 72 and vibrato base 70 so that vibrato armature 72 can move relative to vibrato base 74. This embodiment has a least one flexure plate 28 connected between vibrato armature 72 and vibrato base 74.

Figure 6C:
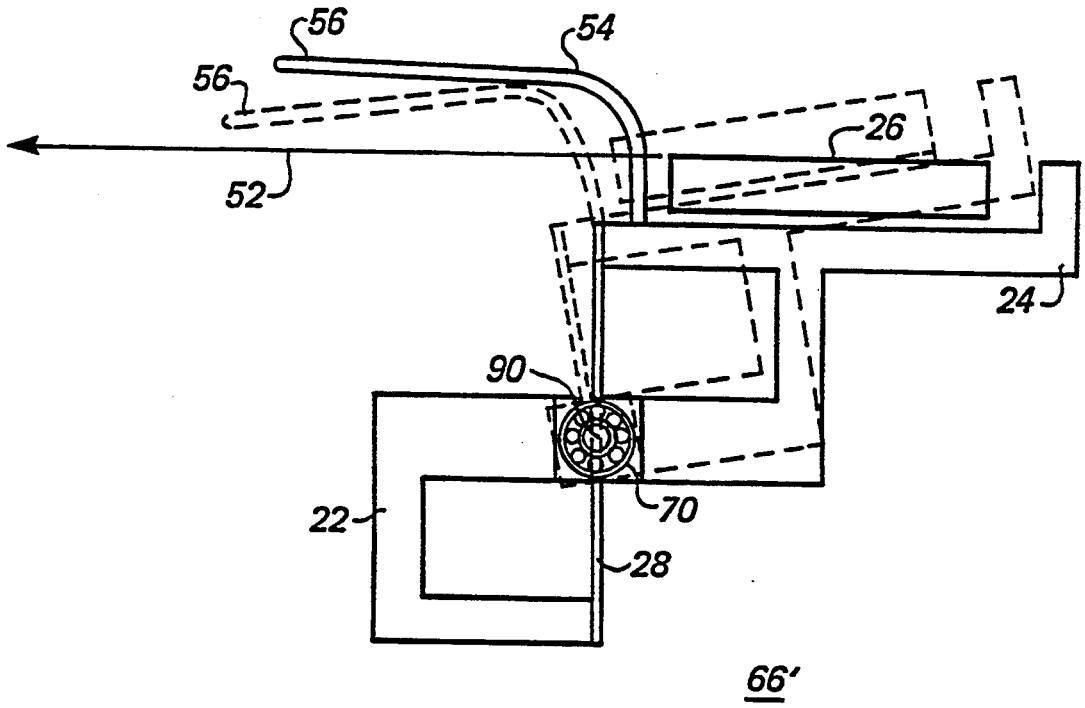
FIG. 6C shows an alternate embodiment of the invention similar to that shown in FIG. 6B except that the flexure bearing and the radial bearing have switched places.

FIG. 6C is a schematic drawing of another configuration of a radial bearing and flexural pivot vibrato assembly 60 with flexure 28 connected in another configuration. There are numerous configurations of this embodiment. The scope of the invention includes embodiments with more than one radial bearing 70 and with radial bearings 70 located in the center of vibrato assembly 66 or at other locations.

Figure 7:
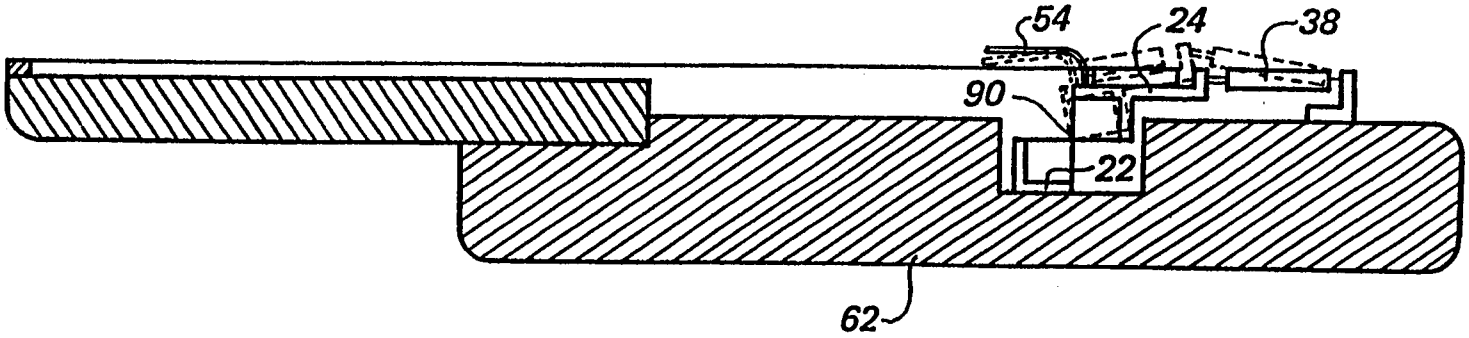
FIG. 7 shows a schematic of the vibrato assembly installed in a recess of a body of a stringed instrument with the tension spring in a horizontal position.

FIG. 7 is a schematic of drawing a vibrato assembly installed in an instrument 62. Vibrato base 22 is mounted to the bottom of a recess in the instrument 62. FIG. 7 shows tension spring 38 mounted on top of instrument 62 and parallel to string 52 but it could be mounted in the recess and perpendicular to string 52.

Figure 8:
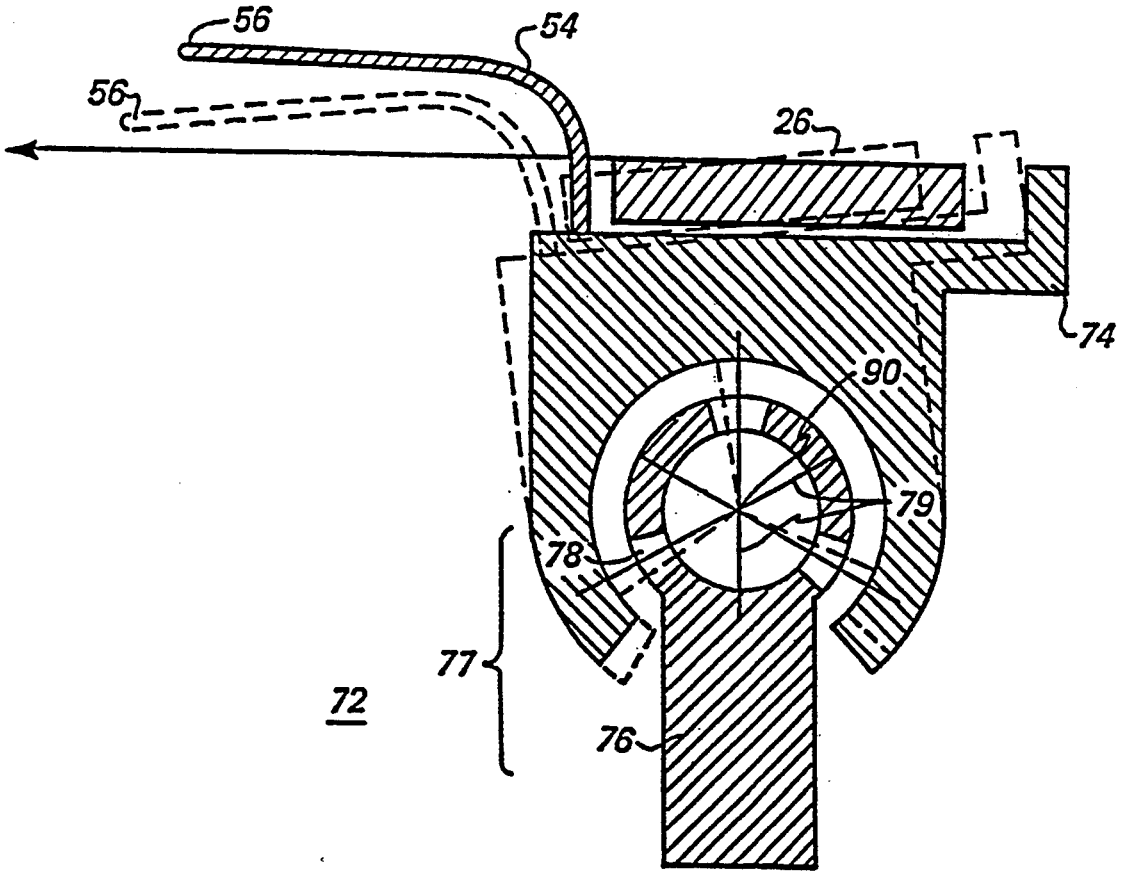
FIG. 8 shows an alternate embodiment with a 120° "Y" cross-strip flexure pivot.

FIG. 8 shows a schematic of a Y cross-strip flexure pivot vibrato assembly 72. A Y cross-strip base 76 and a Y cross-strip armature 74 extend into the page and Y cross-strip base 76 flexibly connects to Y cross-strip armature 74 by way of two Y cross-strip flexure pivot subassemblies 77 located at either end of vibrato assembly 72. FIG. 8 shows one of the Y cross-strip flexure pivot assemblies 77. String saddle 26 is mounted to the top of armature 74. Inside a recess of vibrato armature 74 resides base 76. Y cross-strip flexure pivot subassembly 77 consists of three flexure plates 79 positioned 120° apart and attached to vibrato base 76 and to vibrato armature 74 after passing through clearance holes 78. When an actuating force is applied to handle 54, Y cross-strip armature 74 moves around Y cross-strip base 76 as much as clearance holes 78 will allow. FIG. 8 shows flexure plates 79 as if they intersect and connect together, but they are physically separate and have different axial locations (i.e., they are separated in the direction perpendicular to the plane of the drawing). Additionally, the number of flexures plates in a flexure pivot subassembly can exceed three.

Figure 9:
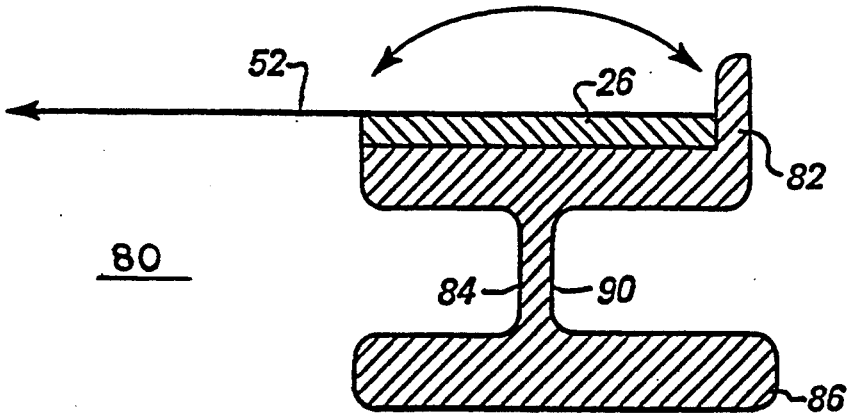
FIG. 9 shows an alternate embodiment of the vibrato assembly having a monolithic flexure.

FIG. 9 shows a vibrato assembly having a monolithic structure 80 that incorporates the vibrato armature 82, monolithic flexure 84, and vibrato base 86 into one jointless structure. This design precludes any possibility of friction but is generally expensive to manufacture. Monolithic structure 80 is typically cut from a single piece of material. Simple configurations, such as the one shown in FIG. 9, can be fabricated using conventional machining operations. More complex configurations may require alternative processes such as wire EDM (electrical discharge machining) followed by chemical deburring. After monolithic structure 80 is machined, flexure 84 can be locally heat treated with a laser to give it the desired hardness. The scope of the invention includes the substitution of monolithic flexures for clamped-flat-spring flexures in all embodiments.

The scope of the invention includes vibrato assemblies that vary the tension of all strings of an instrument at once and those that vary the tension of a subset of all the strings at once. For example, a six string instrument could have six separate vibrato assemblies similar to vibrato assembly 20 shown in FIG. 2C. In this embodiment, each vibrato assembly supports and varies the tension in one string. Additionally, this six string instrument could have three vibrato assemblies where each vibrato assembly varies the tension of two strings 52, et cetera. These individual flexure pivot vibrato assemblies can be separately actuated or jointly actuated by a lever arm (i.e., handle), foot linkage mechanism, and/or a mechanical actuator.

Figure 11:
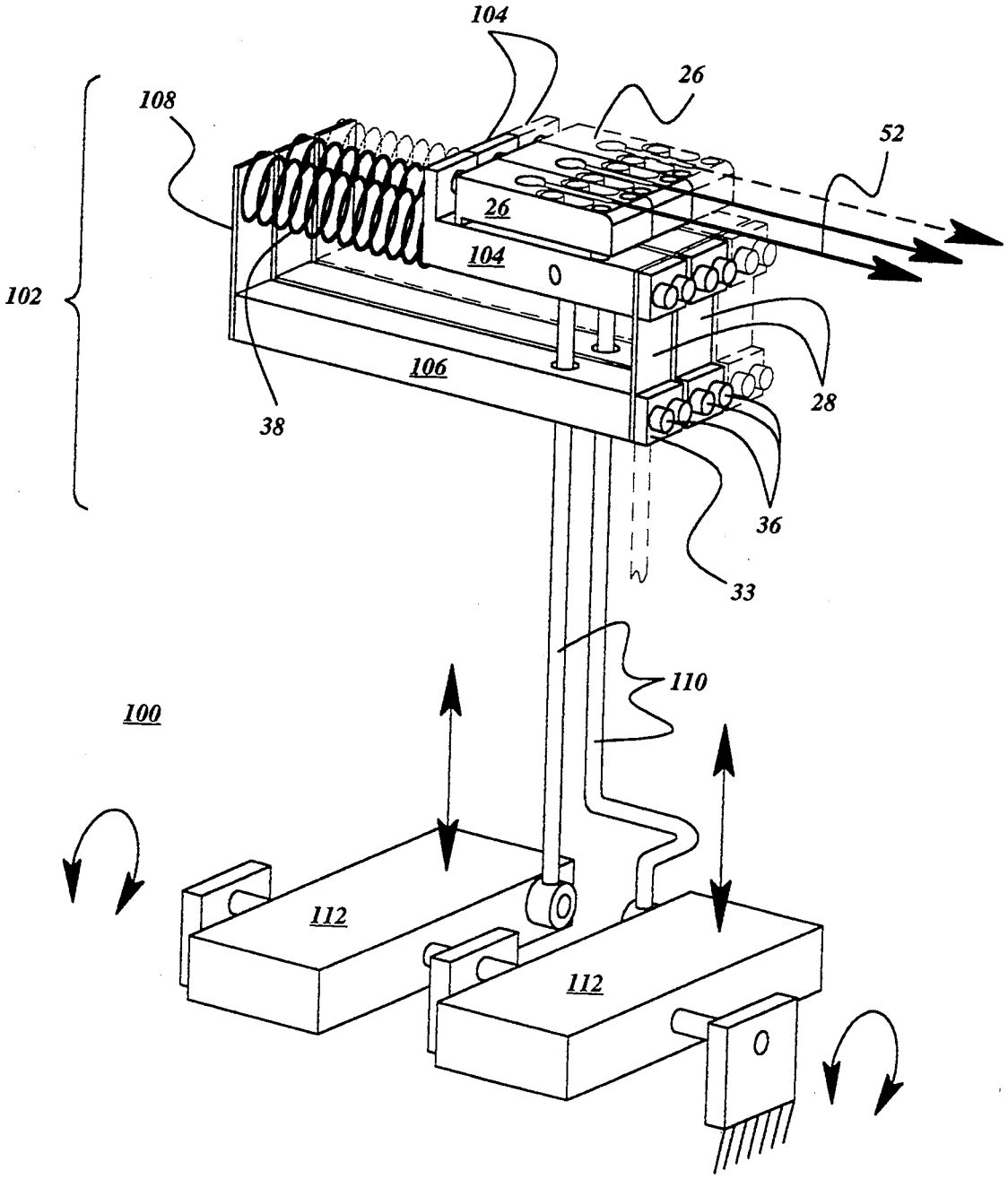
FIG. 11 shows an assembly of individually actuated vibratos that varies the tension of each string independently of the others.

FIG. 11 shows an embodiment of the above described concept. The tension of each string 52 is varied independently of the tension of the other strings 52 by an assembly of individually actuated vibratos 100 that have a singular vibrato assembly 102 for each string 52. Each singular vibrato assembly 102 has a singular armature 104 with a saddle 26 mounted to it that supports and anchors string 52, a singular base 106 that is immovably attached to the instrument (not shown), a spring 38 connected between singular armature 104 and singular tension spring connection plate 108, and an elastic flexure plate 28 that connects to armature 104 and base 106 with clamps 33 and fasteners 36 described previously.

Each singular vibrato armature 104 connects to a foot pedal 112 through a connecting rod 110. When foot pedal 112 is depressed, connecting rod 110 pulls singular armature 104 down (or pushes singular armature 104 up) and causes flexure plate 28 to bend about the x-axis, shown in FIG. 10, with the top portion of flexure plate 28 bending towards spring 38 (or bending away from spring 38). This displacement of singular armature 104 increases (or decreases) the tension of string 52 and increases (decreases) the pitch of its tone. When the actuating force is removed from foot pedal 112, singular armature 104 returns to its original position and restores the tension of string 52 and the pitch of its tone to their original values. FIG. 11 shows two individually actuated vibratos 102 and a third individually actuated vibrato 102 with phantom lines. The scope of the invention includes instruments having any number of individually actuated vibratos 102 and includes instruments having individually actuated vibratos that vary the tension of two or more strings at once. Additionally, the scope of the invention includes instruments that replace the foot pedal with a handle or a machine activated device.

Figure 12A:
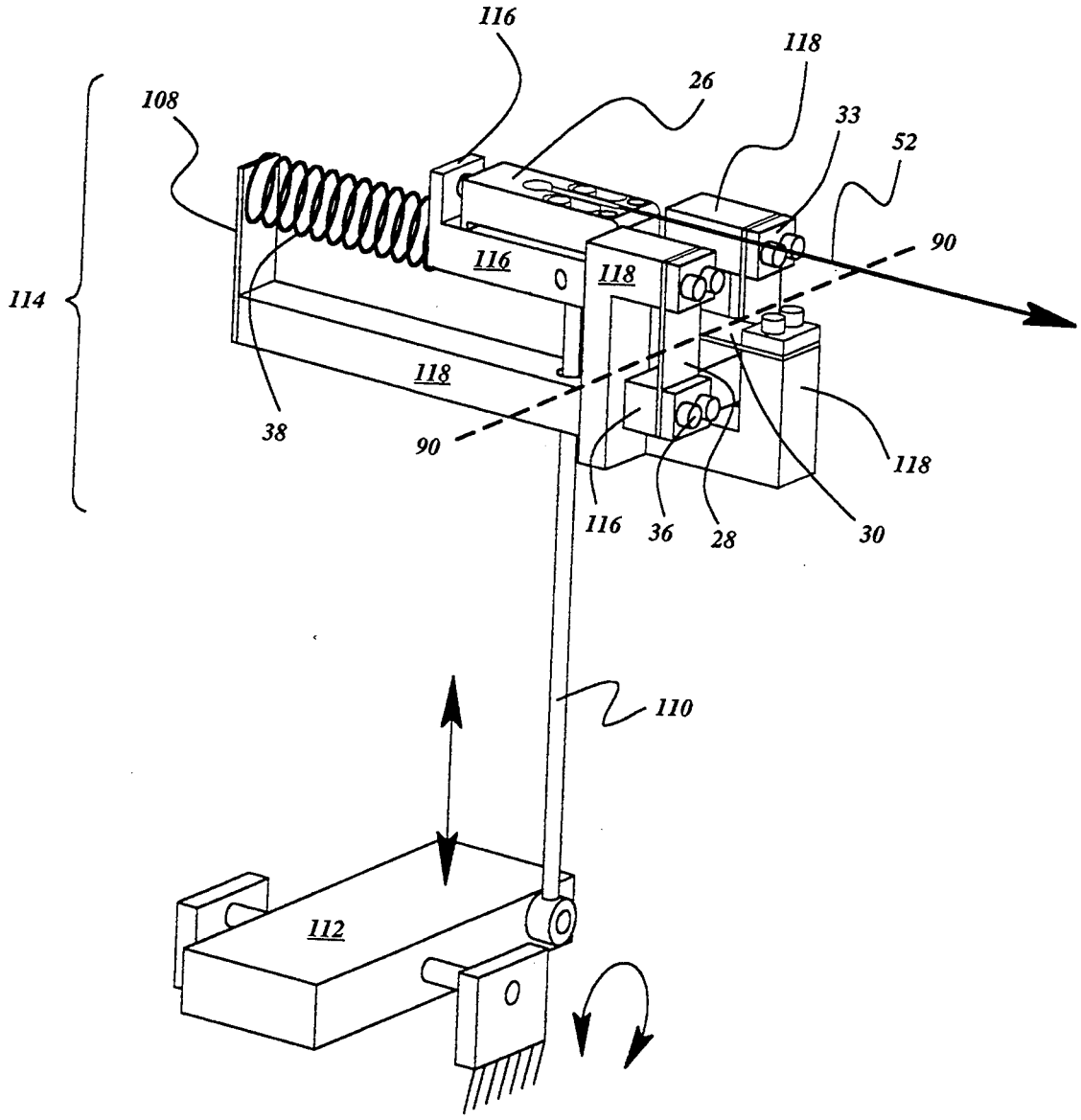
FIGS. 12A shows the preferred embodiment of an individually actuated vibrato.
Figure 12B:
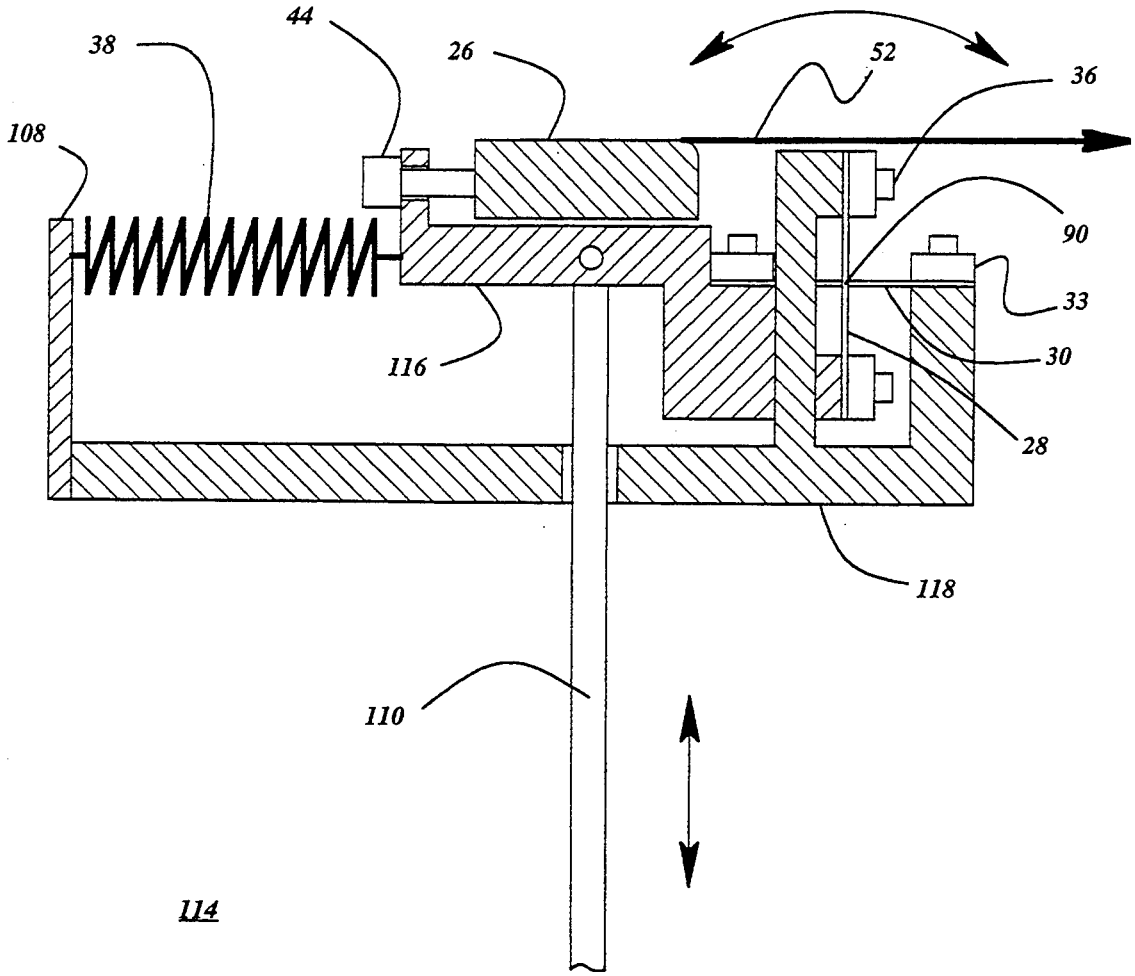
FIG. 12B shows a cross-section of the preferred embodiment of the individually actuated vibrato.

FIGS. 12A and 12B show the preferred embodiment of an individually actuated vibrato 114 that uses three flexures in a cross-strip configuration. As stated previously, cross-strip configurations have the advantage of a well defined axis of rotation and rigidity at the expense of greater complexity. Saddle 26 mounts to a preferred embodiment of a singular armature 116. FIG. 12B shows that the bottoms of two vertical flexure plates 28 and one end of horizontal flexure 30 connect to singular armature 116 using clamps 33 and fasteners 36 mentioned previously. The other end of flexures 28 and 30 connect to singular base 118. Similar to previously described embodiments, spring 38 attaches between singular armature 116 and tension spring connection plate 108 that fastens to singular base 118. The horizontally positioned spring 38 counterbalances the tension in string 52 in this embodiment and that shown in FIG. 11.

The preferred embodiment of singular base 118 mounts on the instrument and does not move. When an actuating force is applied to connecting rod 110, whether it be by a foot pedal 112, a handle, or a machine; singular vibrato armature 116 moves downward (or upward) and rotates in one of the directions shown by the arrows in FIG. 12B. Flexures 28 and 30 bend about an axis 90 with the top of flexures 28 rotating towards (or away from) spring 38. FIGS. 12A and 12B show one individually actuated vibrato 114 to simplify the drawings. In actual use, an instrument could have as many individually actuated vibratos 114 as strings or individually actuated vibratos 114 could be modified to anchor, support and the vary the tension in several strings at once.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen in order to best explain the best mode of the invention. Thus, it is intended that the scope of the invention to be defined by the claims appended hereto.

What is claimed:

1. A vibrato assembly for an instrument having one or more strings, comprising:

a. a vibrato base attached to the instrument;

b. a vibrato armature attached to one or more of the strings; and c. a flexure pivot means for elastically connecting the vibrato armature to the vibrato base.

2. A vibrato assembly, as in claim 1, wherein the flexure pivot means is a flexure plate.

3. A vibrato assembly, as in claim 1, wherein the flexure pivot means is a monolithic flexure.

4. A vibrato assembly, as in claim 1, wherein the flexure pivot means is a cross-strip flexure pivot with at least two flexure plates.

5. A vibrato assembly, as in claim 4, wherein monolithic flexures replace the flexure plates.

6. A vibrato assembly, as in claim 4, wherein the cross-strip flexure pivot further comprises:

a first vertically-oriented flexure plate connected to a first end of the vibrato armature;

a second vertically-oriented flexure plate connected to a second end of the vibrato armature; and a third horizontally-oriented flexure plate connected to approximately the center of the vibrato armature.

7. A vibrato assembly, as in claim 1, wherein the flexure pivot means further comprises:

a first cross-strip flexure pivot subassembly connected to a first end of the vibrato armature; and a second cross-strip flexure pivot subassembly connected to a second end of the vibrato armature.

8. A vibrato assembly, as in claim 1, wherein the flexure pivot means is an asymmetrical cross-strip flexure pivot with at least two flexure plates.

9. A vibrato assembly, as in claim 8, wherein monolithic flexures replace the flexure plates.

10. A vibrato assembly, as in claim 1, wherein the flexure pivot means is an Y cross-strip flexure pivot with at least three flexure plates.

11. A vibrato assembly, as in claim 10, wherein monolithic flexures replace the flexure plates.

12. A vibrato assembly, as in claim 1, further comprising at least one radial bearing connected between the vibrato base and the vibrato armature.

13. A vibrato assembly for an instrument having one or more strings, comprising:

a. a vibrato base attached to the instrument;

b. a vibrato armature attached to at least one of the one or more strings;

c. means for applying an actuating force to the vibrato armature; and d. a flexure pivot means, connected between the vibrato armature and the vibrato base, for elastically deforming in response to the means for applying an actuating force to the vibrato armature, so the vibrato armature can move relative to the vibrato base to vary the tension of the at least one of the one or more strings attached to the vibrato armature, in response to the means for applying an actuating force to the vibrato armature.

14. A vibrato assembly, as in claim 13, wherein the flexure pivot means is a flexure plate.

15. A vibrato assembly, as in claim 13, wherein the flexure pivot means is a monolithic flexure.

16. A vibrato assembly, as in claim 13, wherein the flexure pivot means is a cross-strip flexure pivot subassembly with at least two flexure plates.

17. A vibrato assembly, as in claim 16, wherein monolithic flexures replace the flexure plates.

18. A vibrato assembly, as in claim 16, wherein the cross-strip flexure pivot further comprises:

a first vertically oriented flexure plate connected to a first end of the vibrato armature;

a second vertically oriented flexure plate connected to a second end of the vibrato armature; and a third horizontally oriented flexure plate connected to approximately the center of the vibrato armature.

19. A vibrato assembly, as in claim 13, wherein the flexure pivot means further comprises:

a first cross-strip flexure pivot subassembly connected to a first end of the vibrato armature; and a second cross-strip flexure pivot subassembly connected to a second end of the vibrato armature.

20. A vibrato assembly, as in claim 13, wherein the flexure pivot means is an asymmetrical cross-strip flexure pivot with at least two flexure plates, each connected between the vibrato armature and the vibrato base.

21. A vibrato assembly, as in claim 20, wherein monolithic flexures replace the flexure plates.

22. A vibrato assembly, as in claim 13, the flexure pivot means is an Y cross-strip flexure pivot with at least three flexure plates.

23. A vibrato assembly, as in claim 22, wherein monolithic flexures replace the flexure plates.

24. A vibrato assembly, as in claim 13, further comprising at least one radial bearing connected between the vibrato base and the vibrato armature.

25. A vibrato assembly, as in claim 13, wherein the means for actuating further comprises a foot pedal connected to the vibrato armature with a connecting rod.

26. A vibrato assembly, as in claim 13, wherein the means for actuating further comprises a handle connected to the vibrato armature.

27. A method for creating a vibrato effect in an instrument having a string, comprising the steps of:

a. connecting a vibrato armature to a vibrato base with a flexure pivot;

b. stretching the flexure pivot by applying a force to the vibrato armature;

c. moving the vibrato armature relative to the vibrato base; and d. varying the tension in the string.

28. A method for creating a vibrato effect, as in claim 27, further comprising the steps of:

e. terminating an actuating force stretching the flexure pivot; and f. returning the vibrato armature to an original position of the vibrato armature.

* * * * *